US009695767B2

(12) United States Patent
Lee et al.

(10) Patent No.: US 9,695,767 B2
(45) Date of Patent: Jul. 4, 2017

(54) CONTROL DEVICE AND CONTROL METHOD FOR INTERNAL COMBUSTION ENGINE

(71) Applicants: Sunki Lee, Nissin (JP); Yuji Miyanoo, Seto (JP)

(72) Inventors: Sunki Lee, Nissin (JP); Yuji Miyanoo, Seto (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 205 days.

(21) Appl. No.: 14/377,609

(22) PCT Filed: Feb. 11, 2013

(86) PCT No.: PCT/IB2013/000214

§ 371 (c)(1),
(2) Date: Aug. 8, 2014

(87) PCT Pub. No.: WO2013/121280

PCT Pub. Date: Aug. 22, 2013

(65) Prior Publication Data

US 2016/0010578 A1 Jan. 14, 2016

(30) Foreign Application Priority Data

Feb. 14, 2012 (JP) ..... 2012-029515

(51) Int. Cl.
*F02D 41/02* (2006.01)
*F02D 41/06* (2006.01)
(Continued)

(52) U.S. Cl.
CPC ..... *F02D 41/0235* (2013.01); *F02D 41/065* (2013.01); *F02D 41/1482* (2013.01);
(Continued)

(58) Field of Classification Search
CPC .... F02D 41/065; F02D 41/34; F02D 41/1483; F02D 41/1441; F02D 2250/02; F02D 41/1482; F02D 41/0235; F02D 2041/1422
See application file for complete search history.

(56) References Cited

U.S. PATENT DOCUMENTS 4,777,924 A 10/1988 Fujimura et al.
6,026,794 A * 2/2000 Kadowaki ..... F02D 41/22 123/674
(Continued)

FOREIGN PATENT DOCUMENTS

DE 11-107829 4/1999
JP 62-111144 5/1987
(Continued)

*Primary Examiner* — Hung Q Nguyen
*Assistant Examiner* — Xiao Mo
(74) *Attorney, Agent, or Firm* — Finnegan, Henderson, Farabow, Garrett & Dunner, LLP

(57) ABSTRACT

An ECU acquires a fluid temperature, a coolant temperature and a soak time, and determines whether vapors have been produced in a fuel supply device on the basis of a vapor production prediction map. When the ECU determines that vapors have been produced in the fuel supply device, the ECU reduces a feedback gain. Subsequently, the ECU predicts a vapor production time, and, when the ECU determines that a vapor production end time has been reached, executes normal feedback control.

4 Claims, 5 Drawing Sheets

(51) Int. Cl.
*F02D 41/34* (2006.01)
*F02D 41/14* (2006.01)

(52) U.S. Cl.
CPC ..... *F02D 41/1483* (2013.01); *F02D 41/34* (2013.01); *F02D 41/1441* (2013.01); *F02D 2041/1422* (2013.01); *F02D 2250/02* (2013.01)

(56) References Cited

U.S. PATENT DOCUMENTS

| | | | | |
|---|---|---|---|---|
| 6,240,908 | B1 * | 6/2001 | Hyodo | F02M 25/0809 123/198 D |
| 2011/0191005 | A1 * | 8/2011 | Iwazaki | G01M 15/00 701/101 |

FOREIGN PATENT DOCUMENTS

| | | |
|---|---|---|
| JP | 63-162945 | 7/1988 |
| JP | 63-170533 | 7/1988 |

* cited by examiner

CONTROL DEVICE AND CONTROL METHOD FOR INTERNAL COMBUSTION ENGINE

CROSS-REFERENCE TO RELATED APPLICATIONS

This application is a national phase application of International Application No. PCT/IB2013/000214, filed Feb. 11, 2013, and claims the priority of Japanese Application No. 2012-029515, filed Feb. 14, 2012, the content of both of which is incorporated herein by reference.

BACKGROUND OF THE INVENTION

1. Field of the Invention

The invention relates to a control device and control method for an internal combustion engine.

2. Description of Related Art

In an existing art, a vehicle that is driven by an, internal combustion engine includes an exhaust gas purification catalyst and an air-fuel ratio sensor in an exhaust passage of the internal combustion engine, and includes a control device that brings an air-fuel ratio of the internal combustion engine close to a stoichiometric air-fuel ratio on the basis of a detected result detected by the air-fuel ratio sensor such that exhaust gas purification performance in the exhaust gas purification catalyst improves.

Generally, a fuel supply device that supplies fuel into a combustion chamber of an internal combustion engine is installed in a vehicle. The pressure of fuel in a fuel tank is increased to a predetermined fuel pressure by the fuel supply device, and the fuel is supplied into the combustion chamber of the internal combustion engine. In the fuel supply device, as the internal combustion engine stops, fuel that is accumulating in the fuel supply device near the combustion chamber becomes a high temperature, so vapors may be produced in the fuel. Therefore, in the case where the internal combustion engine restarts while vapors have been produced in the fuel in the fuel supply device, when the control device executes air-fuel ratio feedback control, the amount of fuel that is supplied into the combustion chamber deviates from a target amount of fuel, so feedback becomes instable, which may influence fuel economy and exhaust gas characteristic. Then, there is known a control device for an internal combustion engine, which, when vapors have been produced in fuel in a fuel supply device during a stop of the internal combustion engine, stops air-fuel ratio feedback control at the time of a restart of the internal combustion engine (for example, see Japanese Patent Application Publication No. 63-170533 (JP 63-170533 A)).

The existing control device for an internal combustion engine, which is described in JP 63-170533 A, increases a fuel injection amount with respect to a usual fuel injection amount after a start of the internal combustion engine, and stops air-fuel ratio feedback control for a predetermined period of time from the beginning of the start of the internal combustion engine.

With this configuration, the control device for an internal combustion engine, described in JP 63-170533 A, increases the fuel injection amount with respect to the usual fuel injection amount immediately after a start of the internal combustion engine, so vapors are promptly removed from the fuel supply device, and, in a situation that a variation in air-fuel ratio may occur due to supply of fuel containing vapors to the internal combustion engine, the control device, delays a start of air-fuel ratio feedback control and, after vapors are sufficiently removed from the fuel supply device, executes air-fuel ratio feedback control. By so doing, it is possible to stably restart the internal combustion engine.

However, in the above-described existing control device for an internal combustion engine, described in JP 63-170533 A, at the stage of a restart of the internal combustion engine, execution of air-fuel ratio feedback control is stopped, and an increase in the amount of fuel is continued. After that, fuel may be excessively supplied to the internal combustion engine, and there is a case where the air-fuel ratio significantly deviates toward a rich side at the time of a restart of the internal combustion engine. Therefore, in the control device for an internal combustion engine, described in JP 63-170533 A, there is a problem that fuel economy deteriorates or exhaust gas characteristic deteriorates.

In addition, in the above-described existing control device for an internal combustion engine, described in JP 63-170533 A, if an increase in the amount of fuel at the time of a restart of the internal combustion engine is performed without stopping executing air-fuel ratio feedback control at the time of a restart of the internal combustion engine, the air-fuel ratio deviates toward a rich side, so the fuel injection amount reduces such that the air-fuel ratio is corrected toward a lean side through air-fuel ratio feedback control. When fuel injected into the combustion chamber contains large amounts of vapors in this state, the amount of fuel that is supplied to the internal combustion engine may become smaller than a minimum amount that is required to maintain the rotation of the internal combustion engine and, as a result, engine stalling may occur.

SUMMARY OF THE INVENTION

The invention provides a control device and control method for an internal combustion engine, which are able to suppress deterioration of exhaust gas characteristic and occurrence of engine stalling by optimizing air-fuel ratio control at the time of a start of the internal combustion engine.

An aspect of the invention provides a control device for an internal combustion engine. The control device includes: an air-fuel ratio detecting unit provided in an exhaust passage of the internal combustion engine and configured to detect an air-fuel ratio of exhaust gas of the internal combustion engine; a vapor prediction unit configured to predict whether vapors have been produced in fuel in a fuel supply device at the time of a start of the internal combustion engine; and a feedback control unit configured to execute air-fuel ratio feedback control for bringing the air-fuel ratio in the internal combustion engine close to a target air-fuel ratio by controlling a fuel injection amount of the fuel supply device, the fuel supply device injecting fuel into a combustion chamber of the internal combustion engine, on the basis of the air-fuel ratio detected by the air-fuel ratio detecting unit, and the feedback control unit being configured to decrease a feedback gain in the air-fuel ratio feedback control when the vapor prediction unit predicts that vapors have been produced as compared with when the vapor prediction unit predicts that vapors have not been produced.

Another aspect of the invention provides a control method for an internal combustion engine. The control method includes: detecting an air-fuel ratio of exhaust gas in an exhaust passage of the internal combustion engine; predicting whether vapors have been produced in fuel in a fuel supply device at the time of a start of the internal combustion engine; and executing air-fuel ratio feedback control for bringing the air-fuel ratio in the internal combustion engine close to a target air-fuel ratio by controlling a fuel injection amount of the fuel supply device, the fuel supply device injecting fuel into a combustion chamber of the internal combustion engine, on the basis of the detected air-fuel ratio, and decreasing a feedback gain in the air-fuel ratio feedback control when it is predicted that vapors have been produced as compared with when it is predicted that vapors have not been produced.

With the above control device and control method for an internal combustion engine, when vapors have been produced in the fuel supply device, it is possible to decrease the feedback gain in the air-fuel ratio feedback control. By so doing, even when the fuel injection amount is increased in order to promptly remove vapors from the fuel supply device, it is possible to suppress occurrence of engine stalling due to a decrease in the fuel injection amount such that the air-fuel ratio is corrected toward a lean side through air-fuel ratio feedback control. In addition, it is possible to execute air-fuel ratio feedback control from a start of the internal combustion engine, so it is possible to suppress an excessive increase in the fuel injection amount when vapors in the fuel supply device are removed in the case where air-fuel ratio feedback control is not executed at the time of a start of the internal combustion engine. Thus, it is possible to suppress deterioration of exhaust gas characteristic and occurrence of engine stalling by optimizing air-fuel ratio feedback control at the time of a start of the internal combustion engine.

In the control device, the vapor prediction unit may predict whether vapors have been produced in the fuel supply device on the basis of a lubricant temperature and coolant temperature of the internal combustion engine and a stop time of the internal combustion engine.

With the above control device, it is possible to accurately predict whether vapors have been produced, and execute air-fuel ratio feedback control in response to a situation of production of vapors.

In the control device, the feedback control, unit may end a decrease in the feedback gain after a lapse of a predetermined period of time from a start of the internal combustion engine.

With the above control device, when vapors contained in fuel in the fuel supply device are removed, it is possible to further promptly bring an actual air-fuel ratio into coincidence with a target air-fuel ratio by returning the feedback gain to a normal value.

The control device may further include an intake air amount detecting unit configured to detect an amount of air that is taken into the internal combustion engine, wherein the feedback control unit may set the predetermined period of time on the basis of the amount of air, the amount of air being detected by the intake air amount detecting unit.

With the above control device, it is possible to accurately estimate a period of time during which vapors contained in fuel in the fuel supply device are removed, so, when vapors have been removed, it is possible to promptly return the feedback gain to a normal value.

With the above-described control device and control method for an internal combustion engine, it is possible to provide a control device and control method for an internal combustion engine, which are able to suppress deterioration of exhaust gas characteristic and occurrence of engine stalling by optimizing air-fuel ratio control at the time of a start of the internal combustion engine.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
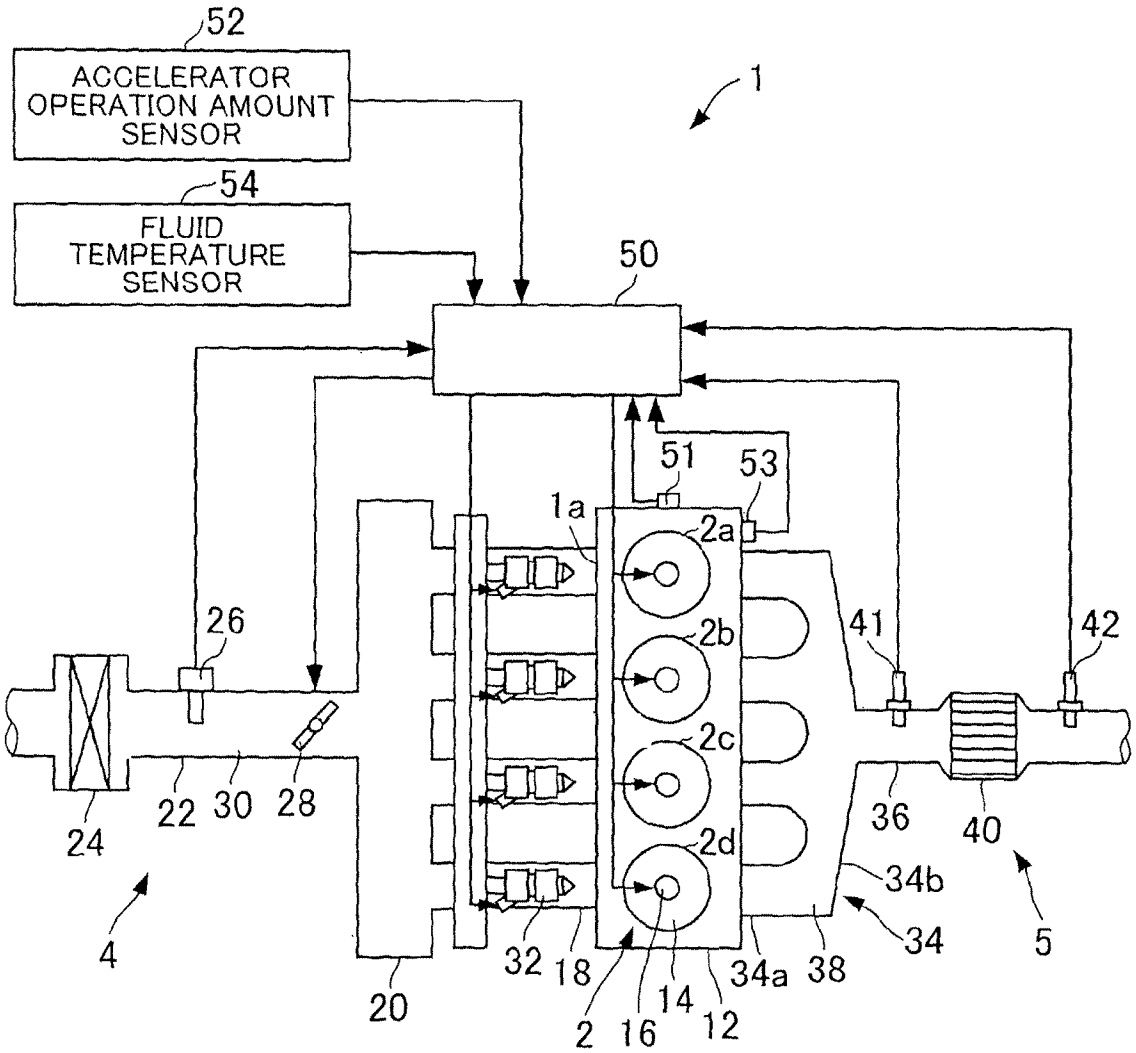
FIG. 1 is a schematic configuration view that shows an internal combustion engine according to an embodiment of the invention.

Hereinafter, an embodiment of the invention will be described with reference to the accompanying drawings. First, a configuration will be described. As shown in FIG. 1, a control device for an internal combustion engine according to the present embodiment is equipped for an engine 1 that has a plurality of cylinders 2, and is configured to inject fuel into each cylinder 2 independently of each other. In the following description, description will be made on an example in which the internal combustion engine according to the invention is formed of an in-line four-cylinder gasoline engine. However, the internal combustion engine according to the invention just needs to be formed of an engine having two or more cylinders, and the number of cylinders and the engine type are not limited.

The engine 1 includes a cylinder block 12, a cylinder head (not shown), an intake system unit 4 and an exhaust system unit 5. Four cylinders, that is, a #1 cylinder 2*a*, a #2 cylinder 2*b*, a #3 cylinder 2*c* and a #4 cylinder 2*d*, are formed in the cylinder block 12 and the cylinder head. The intake system unit 4 is used to supply air from the outside of a vehicle to the #1 cylinder 2*a* to the #4 cylinder 2*d*. The exhaust system unit 5 is used to emit exhaust gas from the #1 cylinder 2*a* to the #4 cylinder 2*d* to the outside of the vehicle. In the following description, when it is not necessary to distinguish the cylinders 2 from one another, they are described as the cylinders 2.

Each cylinder 2 forms a combustion chamber 14. By combusting a mixture of fuel and air in the combustion chamber 14, a corresponding piston that is reciprocally movably arranged in the combustion chamber 14 is reciprocally moved. Thus, power is generated. Each piston is connected to a crankshaft via a corresponding connecting rod. Power generated in each cylinder 2 is transmitted to a drive wheel via the crankshaft, a transmission, and the like.

Intake valves and exhaust valves are arranged on the cylinder head. The intake valves open or close corresponding intake ports 1*a*. The exhaust valves open or close corresponding exhaust ports. Ignition plugs 16 are arranged at the top of the cylinder head. Each ignition plug 16 is used to ignite air-fuel mixture introduced into the corresponding combustion chamber 14.

An injector 32 is arranged in the intake port 1*a* of each cylinder 2. Each injector 32 injects fuel. Air-fuel mixture is produced by mixing fuel injected from the injector 32 with air introduced by the intake system unit 4.

The intake system unit 4 includes branch pipes 18, a surge tank 20, an intake pipe 30 and an air cleaner 24. The intake upstream side of the surge tank 20 is connected to the intake pipe 30. The intake upstream side of the intake pipe 30 is connected to the air cleaner 24. An air flow meter 26 and an electronically-controlled throttle valve 28 are arranged in the intake pipe 30 sequentially from the intake upstream side. The air flow meter 26 is used to detect an intake air amount.

The exhaust system unit 5 includes an exhaust manifold 34, an exhaust pipe 36 and a catalytic converter 40, and forms an exhaust passage 38.

The exhaust manifold 34 is connected to exhaust ports that are formed in the cylinder head, and the exhaust manifold 34 and the exhaust pipe 36 are connected to each other via the branch pipes 34*a* and an exhaust collecting unit 34*b*.

The catalytic converter 40 includes a three-way catalyst. When exhaust gas flows into the catalytic converter 40 in the case where the air-fuel ratio in each combustion chamber 14 is close to a stoichiometric air-fuel ratio, the catalytic converter 40 purifies NOx, HC and CO, which are toxic substances in exhaust gas, at the same time.

Here, the air-fuel ratio indicates a value that is obtained by dividing the mass of air of air-fuel mixture, which is supplied to the combustion chambers 14, by the mass of fuel. Instead, it is possible to obtain the air-fuel ratio from components of exhaust gas, which are detected by an air-fuel ratio sensor 41 and an $O_2$ sensor 42 (described later), after the air-fuel mixture is burned in the combustion chambers 14.

The air-fuel ratio sensor 41 and the $O_2$ sensor 42 are respectively arranged in the exhaust pipe 36 on the exhaust upstream and downstream sides of the catalytic converter 40. The air-fuel ratio sensor 41 and the $O_2$ sensor 42 constitute an air-fuel ratio detecting unit according to the invention. Note that a combination of these sensors is just an example, and these sensors just need to be formed of sensors that are able to detect the air-fuel ratio from output values. The air-fuel ratio sensor or the $O_2$ sensor may be arranged only on at least one of the exhaust upstream side and exhaust downstream side of the catalytic converter 40.

Figure 2:
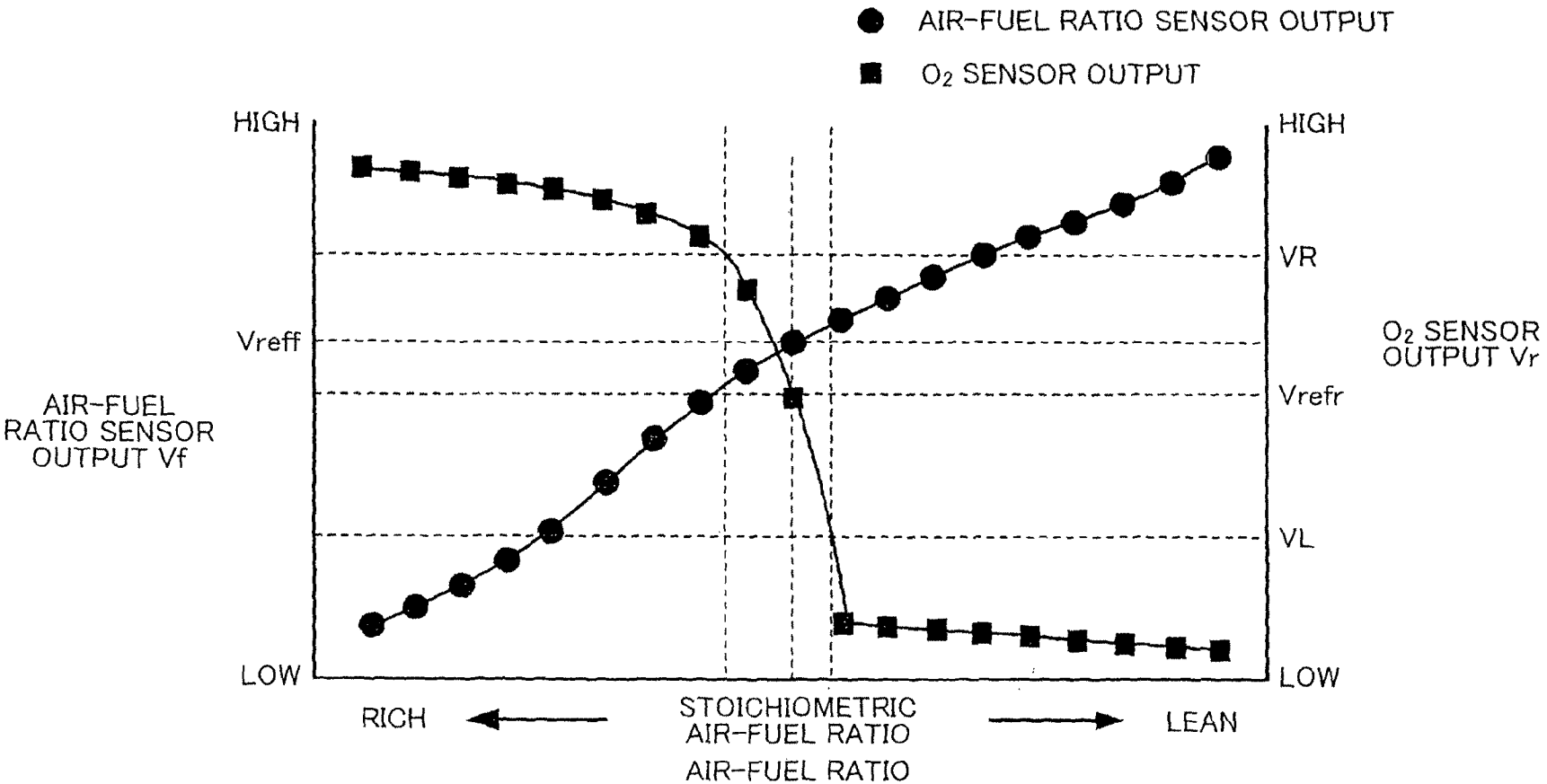
FIG. 2 is a graph for illustrating the characteristic of an air-fuel ratio sensor and the characteristic of an $O_2$ sensor according to the embodiment of the invention.

As shown in FIG. 2, the air-fuel ratio sensor 41 is configured to continuously detect an air-fuel ratio in a wide range from exhaust gas, and is configured to output a voltage signal, which is directly proportional to the detected air-fuel ratio, to an ECU 50. For example, the air-fuel ratio sensor 41 is configured to output a voltage signal of about 3.3 V at the stoichiometric air-fuel ratio.

On the other hand, the $O_2$ sensor 42 has a characteristic such that an output value steeply varies when the air-fuel ratio of air-fuel mixture is the stoichiometric air-fuel ratio. When the air-fuel mixture has the stoichiometric air-fuel ratio, the $O_2$ sensor 42 is configured to output a voltage signal of about 0.45 V to the ECU 50. The output value of the voltage signal is lower than 0.45 V when the air-fuel ratio of the air-fuel mixture is lean, and the output value of the voltage signal is higher than 0.45 V when the air-fuel ratio is rich.

Figure 3:
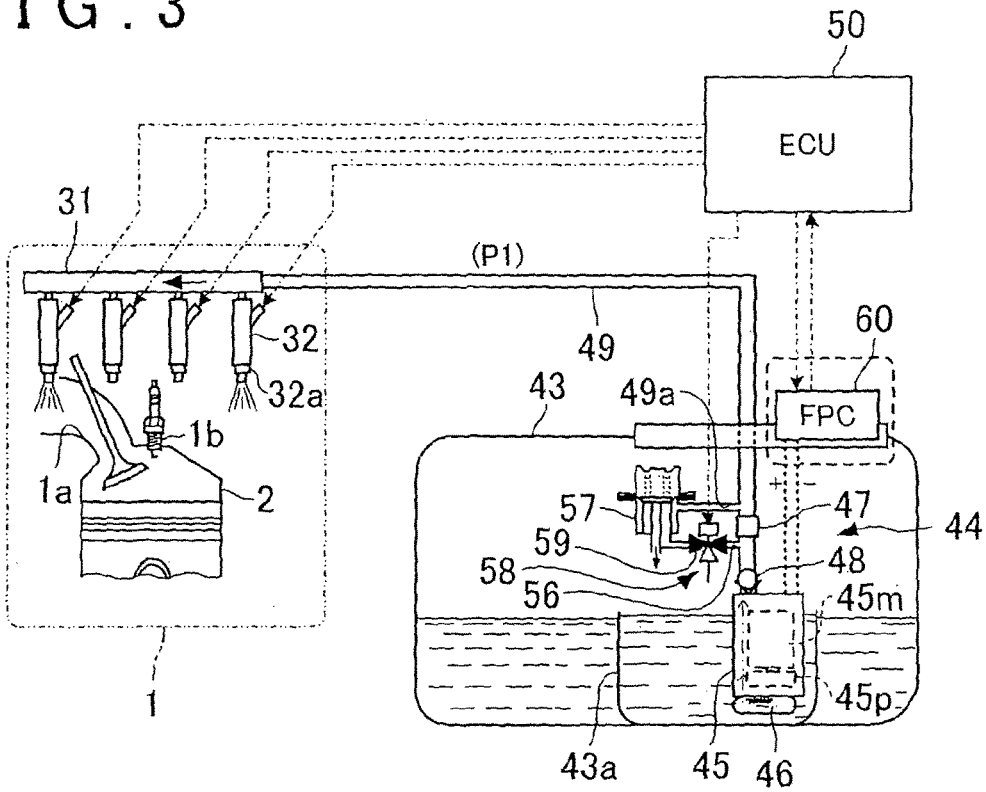
FIG. 3 is a schematic configuration view that shows a fuel supply mechanism according to the embodiment of the invention.
Figure 4:
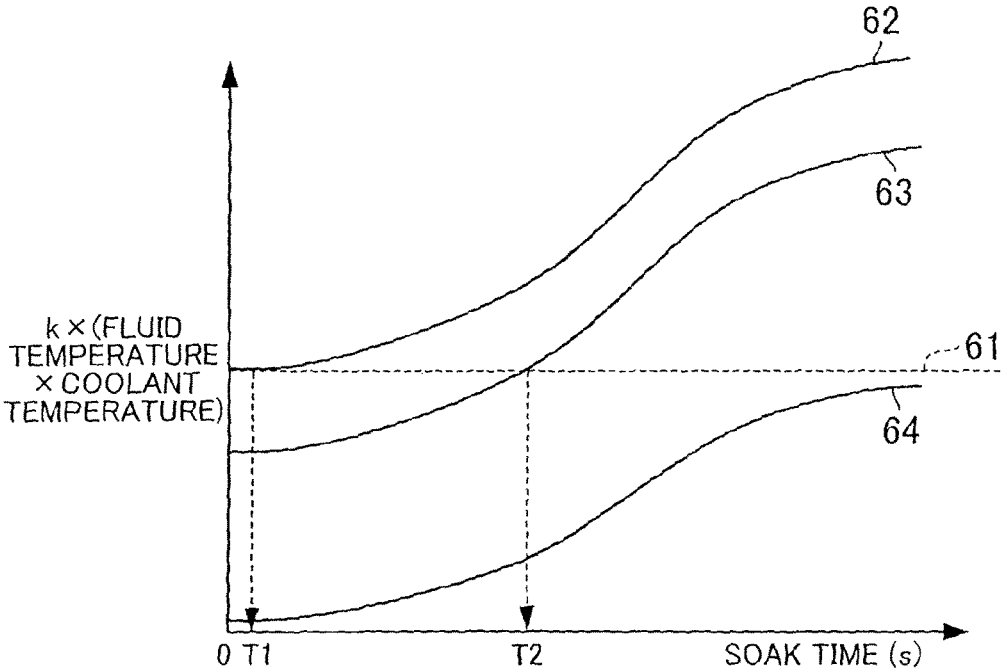
FIG. 4 is a graph that shows a vapor production prediction map according to the embodiment of the invention.

As shown in FIG. 3, the vehicle according to the present embodiment includes a fuel tank 43 and a fuel supply device 44. The fuel tank 43 stores gasoline that is consumed in the engine 1. The fuel supply device 44 feeds and supplies fuel stored in a sub-tank 43*a* of the fuel tank 43 (hereinafter, simply referred to as fuel tank 43) to the plurality of injectors 32 of the engine 1 under pressure, and supplies fuel from these injectors 32 into the combustion chambers 14. The fuel supply device 44 includes a pressure regulator 57 and a set pressure changing operation mechanism 58. The pressure regulator 57 introduces fuel, which is supplied to the injectors 32, regulates the introduced fuel to a preset system pressure P1, and is able to change the system pressure P1 to any one of a plurality of set pressures, such as a high set pressure and a low set pressure. The set pressure changing operation mechanism 58 is able to carry out changing operation of the pressure regulator 57 with the use of a three-way electromagnetic valve 59 such that a currently set pressure of the pressure regulator 57 is changed to the other set pressure.

The injectors 32 provided in correspondence with the plurality of cylinders 2 of the engine 1, for example, expose their injection hole-side end portions 32*a* into the intake ports 1*a* corresponding to the respective cylinders 2. The fuel supply device 44 distributes fuel among the injectors 32 via a delivery pipe 31.

The fuel supply device 44 includes a fuel pump unit 45, a suction filter 46, a fuel filter 47 and a check valve 48. The fuel pump unit 45 draws, pressurizes and discharges fuel in the fuel tank 43. The suction filter 46 blocks suction of foreign matter at a suction port side of the fuel pump unit 45. The fuel filter 47 removes foreign matter in discharged fuel at a discharge port side of the fuel pump unit 45. The check valve 48 is located upstream or downstream of the fuel filter 47.

Although not shown in the drawings in detail, the fuel pump unit 45, for example, includes a fuel pump 45*p* and a pump drive motor 45*m*. The fuel pump 45*p* has a pump actuating impeller. The pump drive motor 45*m* is an internal direct-current motor that drives the fuel pump 45*p* for rotation. The fuel pump unit 45 is driven and stopped through control of the ECU 50 (described later) over current that is supplied to the pump drive motor 45*m*.

The fuel pump unit 45 is able to draw, pressurize and discharge fuel from the fuel tank 43. The fuel pump unit 45 is able to change a discharge capacity and discharge pressure per unit time by changing the rotation speed [rpm] of the pump drive motor 45*m* with respect to the same supply voltage in response to a load torque or changing the rotation speed of the pump drive motor 45*m* in response to a change in supply voltage.

The check valve 48 opens in a direction in which fuel is supplied from the fuel pump unit 45 toward the injectors 32, and closes in a direction in which fuel flows back from the injectors 32 to the fuel pump unit 45 to block backflow of pressurized supply fuel.

The ECU 50 has the function of executing feedback control over the driving voltage of the pump drive motor 45*m* in cooperation with a fuel pump controller 60 by generating a command value for the driving voltage of the pump drive motor 45*m*, corresponding to the discharge capacity of the fuel pump unit 45, such that the discharge capacity is set to an optimal value in response to a fuel injection amount that is required to operate the engine 1.

A fluid introducing port of the pressure regulator 57 is connected to a fuel passage 49 via a branch passage 49*a*. The fuel passage 49 is a circuit portion downstream of the check valve 48. An operating pressure introducing hole of the pressure regulator 57 is connected to a branch passage 56 via the three-way electromagnetic valve 59. The branch passage 56 is a circuit portion downstream of the check valve 48 and upstream of the fuel filter 47.

Referring back to FIG. 1, the engine 1 according to the present embodiment further includes the electronic control unit (ECU) 50 that constitutes the control device for an internal combustion engine. The ECU 50 includes a central processing unit (CPU), a random access memory (RAM), a read only memory (ROM), a backup memory, and the like. The ECU 50 according to the present embodiment constitutes a control device, a feedback control unit, a vapor prediction unit and an intake air amount detecting unit according to the invention.

The ROM stores various control programs that include control programs for executing air-fuel ratio feedback control (described later) and fuel injection control in the cylinders 2, maps that are consulted when these various control programs are executed, and the like. The CPU is configured to execute various computation processes on the basis of the various control programs and maps stored in the ROM. The RAM temporarily stores computation results of the CPU, data input from the above-described sensors, and the like. The backup memory is formed of a nonvolatile memory, and is, for example, configured to store data, and the like, that should be saved at the time of a stop of the engine 1.

The CPU, the RAM, the ROM and the backup memory are connected to one another via a bus, and are connected to an input interface and an output interface.

The engine 1 includes a crank angle sensor 51, an accelerator operation amount sensor 52, a coolant temperature sensor 53 and a fluid temperature sensor 54. The crank angle sensor 51 is used to detect the rotation speed of the crankshaft, that is, an engine rotation speed. The accelerator operation amount sensor 52 is used to detect an accelerator operation amount. The coolant temperature sensor 53 is used to detect the coolant temperature of the engine 1. The fluid temperature sensor 54 detects the lubricant temperature of the engine 1. Signals of these sensors are transmitted to the ECU 50.

A throttle opening degree sensor (not shown) is arranged in the throttle valve 28, and is configured to transmit a signal, corresponding to a throttle opening degree, to the ECU 50. The ECU 50 executes feedback control on the basis of a signal that is input from the throttle opening degree sensor such that the opening degree of the throttle valve 28 becomes a throttle opening degree that is determined on the basis of an accelerator operation amount.

The ECU 50 calculates an intake air amount per unit time on, the basis of the signal input from the air flow meter 26. The ECU 50 is configured to calculate an engine load from the detected intake air amount and engine rotation speed.

The ECU 50 is configured to execute air-fuel ratio feedback control for bringing an actual air-fuel ratio close to a target air-fuel ratio. In the present embodiment, the ECU 50 adjusts the fuel injection amount in each cylinder 2 on the basis of a signal input from the air-fuel ratio sensor 41 arranged on the exhaust upstream side of the catalytic converter 40, and is configured to execute main feedback control for bringing an actual air-fuel ratio that is detected by the air-fuel ratio sensor 41 close to a target air-fuel ratio, such as the stoichiometric air-fuel ratio.

The main feedback control is formed of known proportional integral derivative control (PID control) that calculates a proportional term, an integral term as a learned value, and a derivative term from a difference between an actual air-fuel ratio and the target air-fuel ratio, and a proportional gain, an integral gain and a derivative gain empirically obtained in advance, and that calculates a correction amount for a currently set fuel injection amount from the sum of the proportional term, the integral term and the derivative term. The main feedback control just needs to be known feedback control, such as proportional integral control (PI control) that calculates a correction amount on the basis of a proportional term and an integral term.

Furthermore, the ECU 50 is configured to execute sub-feedback control that further corrects the correction amount, which is calculated through main feedback control, on the basis of a signal input from the $O_2$ sensor 42 arranged on the exhaust downstream side of the catalytic converter 40. In the present embodiment, the ECU 50 is configured to execute known feedback control, such as PID control and PI control, on the basis of a difference between a target value of an output voltage value of the $O_2$ sensor 42 and an actual output voltage value that is currently output from the $O_2$ sensor 42 such that the target value of the output voltage value coincides with the actual output voltage value. Here, the target value of the output voltage value is usually set to a voltage value corresponding to the stoichiometric air-fuel ratio, that is, a voltage value close to 0.45 V; however, the target value is changed due to aged degradation of the $O_2$ sensor 42 or various controls, such as target air-fuel ratio changing control (described later).

Hereinafter, the characteristic configuration of the ECU 50 that constitutes the control device for an internal combustion engine according to the present embodiment will be described with reference to FIG. 1 to FIG. 5.

As described above, the ECU 50 adjusts the fuel injection amount in each cylinder 2 on the basis of the signal input from the air-fuel ratio sensor 41 arranged on the exhaust upstream side of the catalytic converter 40 during a start of the engine 1, and is configured to execute main feedback control for bringing an actual air-fuel ratio that is detected by the air-fuel ratio sensor 41 close to a target air-fuel ratio, such as the stoichiometric air-fuel ratio.

The ECU 50 is configured to determine whether vapors have been produced in fuel accumulating inside the fuel supply device 44 during a stop of the engine 1. Specifically, the ECU 50 acquires a signal that indicates the lubricant temperature of the engine 1 from the fluid temperature sensor 54, and acquires a signal that indicates the coolant temperature of the engine 1 from the coolant temperature sensor 53.

The ECU 50 acquires a soak time by consulting a timer. Specifically, the ECU 50 is configured to start counting with the use of the timer at the time of a stop of the engine 1, and is configured to acquire a soak time that is an elapsed time from a previous engine stop by consulting the timer at the time of a current restart of the engine.

The ECU 50 is configured to determine whether vapors have been produced in the fuel supply device 44, such as the delivery pipe 31, on the basis of these fluid temperature, coolant temperature and soak time. The ECU 50 is configured to determine whether vapors have been produced by consulting a vapor production prediction map shown in FIG. 4.

The vapor production prediction map is expressed by a graph of which the abscissa axis represents a soak time and the ordinate axis represents the product of a fluid temperature and a coolant temperature. Actually, the ECU 50 is configured to use a value obtained by multiplying the product of a fluid temperature and a coolant temperature by a coefficient k. The coefficient k is set on the basis of the specifications of the vehicle, and is obtained through empirical measurement in advance. In the following description, the product of a fluid temperature and a coolant temperature means a value obtained by multiplying the product of a fluid temperature and a coolant temperature by the coefficient k.

In the vapor production prediction map, a determination line 61 by which it is determined whether vapors are produced is set, and the ECU 50 determines that vapors have been produced in fuel inside the fuel supply device 44 when the product of a fluid temperature and a coolant temperature exceeds the determination line 61 in a certain soak time.

For example, at the time of a previous engine stop, that is, at a soak time 0, when the product of a fluid temperature and a coolant temperature is a value in a solid line 62, the product of a fluid temperature and a coolant temperature exceeds the determination line 61 when the soak time becomes longer than T1. When the product of a fluid temperature and a coolant temperature is a value in a solid line 63 at the time of a previous engine stop, the product of a fluid temperature and a coolant temperature exceeds a determination line 61 when the soak time becomes longer than T2.

When the product of a fluid temperature and a coolant temperature at the time of a previous engine stop is a value in a solid line 64, the product of a fluid temperature and a coolant temperature does not exceed a determination line 61 irrespective of a soak time. In this way, production of vapors varies depending on a fluid temperature, a coolant temperature and a soak time, and the ECU 50 is configured to determine whether vapors have been produced on the basis of the vapor production prediction map shown in FIG. 4.

When the ECU 50 determines that vapors have been produced on the basis of the vapor production prediction map, the ECU 50 is configured to increase the fuel injection amount with respect to a usual fuel injection amount at the time of a restart of the engine 1 such that engine stalling does not occur through a decrease in the amount of fuel due to the fact that vapors are contained in fuel at the time when fuel is injected into the combustion chambers 14.

At this time, the air-fuel ratio deviates toward a rich side through an increase in the amount of fuel; however, air-fuel ratio feedback control is being executed, so, in the existing art, the fuel injection amount is decreased such that the air-fuel ratio deviated toward a rich side is corrected toward a lean side. Therefore, when vapors are injected from each injector 32 at timing at which the fuel injection amount is reduced, the amount of fuel actually supplied further reduces, and engine stalling may occur.

Therefore, when the ECU 50 according to the present embodiment determines that vapors have been produced at the time of a restart of the engine 1, the fuel injection amount is increased, and a feedback gain in air-fuel ratio feedback control is decreased. By so doing, a steep reduction in fuel injection amount is suppressed.

Figure 5:
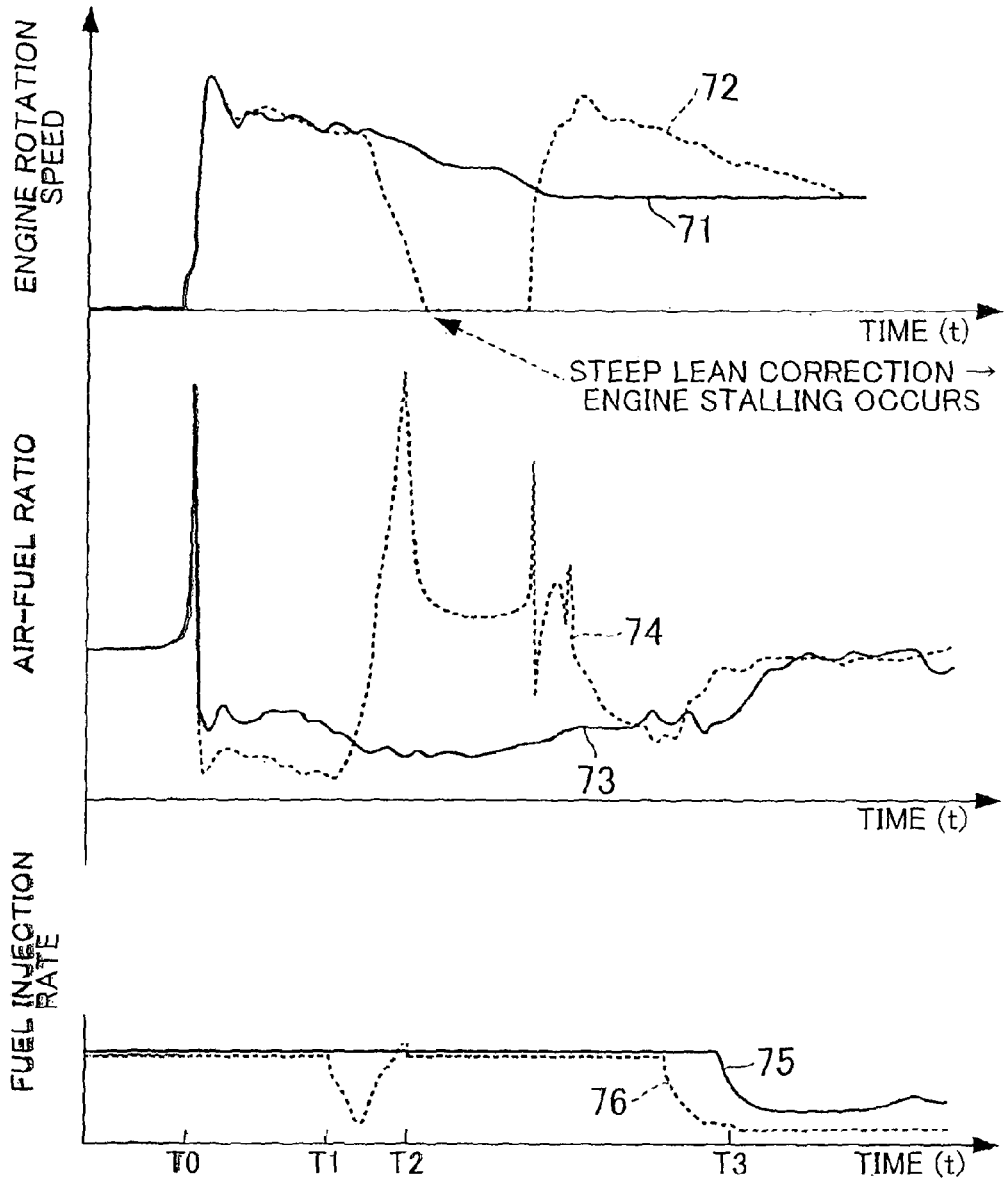
FIG. 5 is a graph that shows the state of the internal combustion engine according to the embodiment of the invention.

FIG. 5 is a graph that shows a variation in engine rotation speed, air-fuel ratio and fuel injection rate against time when vapors have been produced. In the graph of FIG. 5, the solid lines respectively represent a temporal variation in engine rotation speed, a temporal variation in air-fuel ratio and a temporal variation in fuel injection rate in the present embodiment. The broken tines respectively represent a temporal variation in engine rotation speed, a temporal variation in air-fuel ratio and a temporal variation in fuel injection rate in existing air-fuel ratio feedback control that does not decrease a feedback gain.

In the existing art, when the engine 1 restarts at time T0 (see the broken line 72), after the air-fuel ratio once deviates toward a lean side (see the broken line 74), the air-fuel ratio deviates toward a rich side through an increase in fuel injection amount with respect to a usual fuel injection amount. Because air-fuel ratio feedback control is being executed, the ECU 50 decreases the fuel injection rate at time t1 such that the air-fuel ratio deviated toward a rich side is corrected toward a lean side (see the broken line 76).

Therefore, when large amounts of vapors are contained in fuel, the air-fuel ratio significantly deviates toward a lean side at time T2 (see the broken line 74), and, as a result, engine stalling occurs (see the broken line 72).

In contrast to this, with the ECU 50 according to the present embodiment, when the engine 1 starts at time T0 (see the solid line 71), the air-fuel ratio deviates toward a rich side due to an increase in the amount of fuel (see the solid line 73); however, air-fuel ratio feedback control of which the feedback gain is decreased is being executed, so, different from the case where air-fuel ratio feedback control is stopped until vapors are removed, an excessive increase in fuel injection amount is suppressed. Thus, a deviation of the air-fuel ratio toward a rich side is suppressed. Different from the case where the existing air-fuel ratio feedback control of which the feedback gain is not decreased, a steep correction of the air-fuel ratio toward a lean side is suppressed also in the case where the air-fuel ratio deviates toward a rich side (see the solid line 73), and, as a result, fuel injection control shifts into normal fuel injection control without occurrence of engine stalling.

When vapors in the fuel supply device 44 are removed at time T3, the ECU 50 ends a decrease in the feedback gain, and causes feedback control to shift into normal feedback control.

Note that the feedback gain that is used at the time when vapors have been produced is desirably set to, for example, 1/10 to 1/15 of a normal feedback gain. A change of the feedback gain just needs to be made in any one of the above-described main feedback control and sub-feedback control within air-fuel ratio feedback control, and may be applied to any one of main feedback control and sub-feedback control. At least one of the proportional gain and the derivative gain in main feedback control or sub-feedback control constitutes a feedback gain according to the invention, and the integral gain may also constitute the feedback gain according to the invention.

When the ECU 50 starts air-fuel ratio feedback control at the time when vapors have been produced, the ECU 50 returns to normal control a predetermined period of time later. The predetermined period of time is calculated as a period of time that is required to remove vapors that have been produced in the fuel supply device 44. Here, the period of time that is required to remove vapors is a value based on a fuel consumption. Thus, the ECU 50 calculates the fuel consumption on the basis of an engine rotation speed and an engine load, and calculates the predetermined period of time by dividing the amount of fuel present within a range in which vapors can be produced in the fuel supply device 44 by the fuel consumption. Here, the amount of fuel that is present within the range in which vapors can be produced is obtained through empirical measurement in advance.

As described above, the engine load is calculated on the basis of an intake air amount and an engine rotation speed. Note that the engine load varies on the basis of operating states of auxiliaries, such as an alternator and an air conditioner mounted on the vehicle, so the ECU 50 may acquire the operating states of the alternator, the air-conditioner, and the like, and may calculate the engine load by consulting a map that associates these operating states with an engine load.

Figure 6:
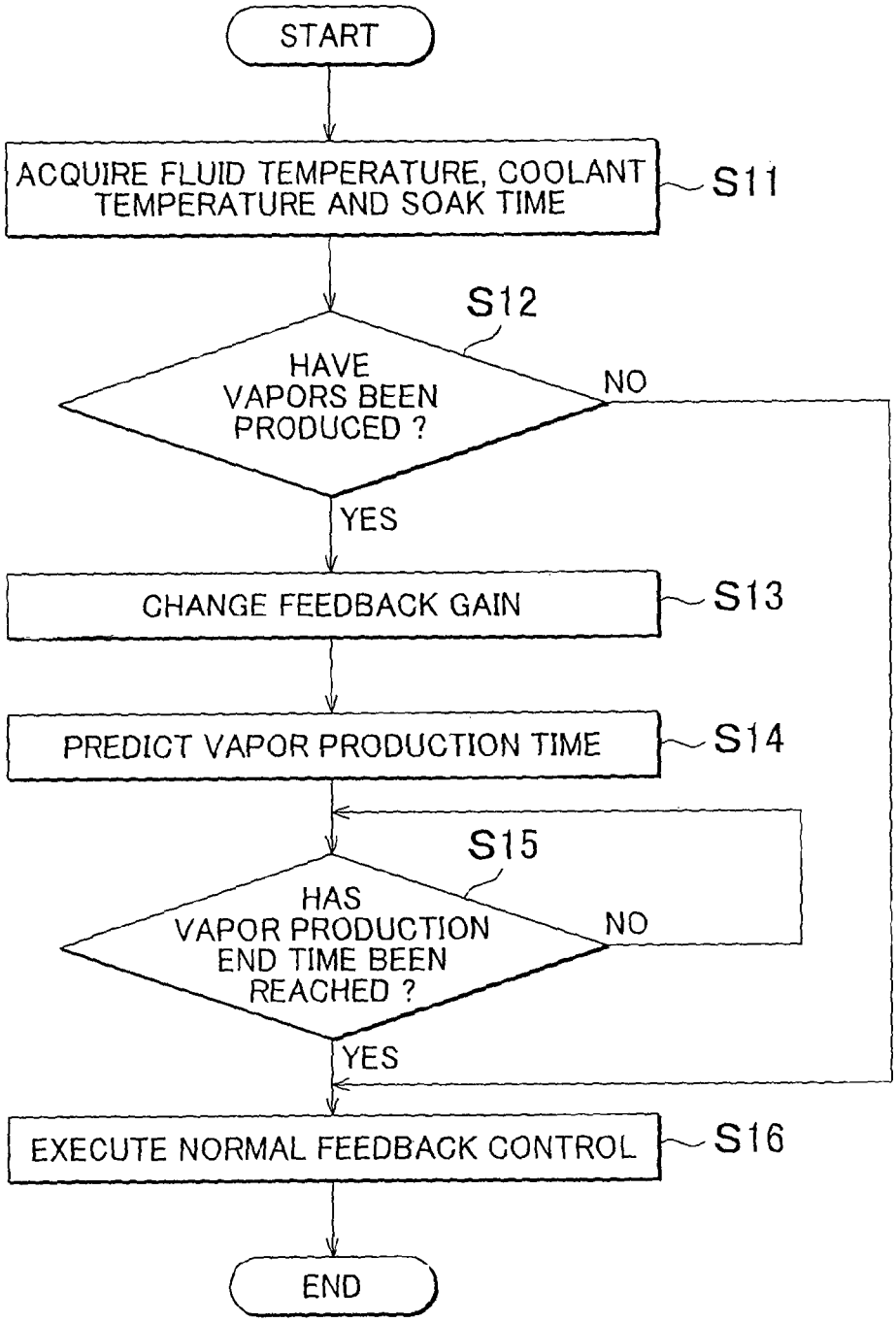
FIG. 6 is a flowchart for illustrating air-fuel ratio feedback control process according to the embodiment of the invention.

Next, an air-fuel ratio feedback control process according to the present embodiment will be described with reference to FIG. 6. The following process is executed in the case where the CPU that constitutes the ECU 50 has acquired a signal that indicates a request to start the engine 1, and implements a program that is processable by the CPU.

First, the ECU 50 acquires a fluid temperature, a coolant temperature and a soak time (step S11). Specifically, the ECU 50 acquires signals that indicate the lubricant temperature and coolant temperature of the engine 1 from the fluid temperature sensor 54 and the coolant temperature sensor 53, and acquires the soak time by consulting the timer. The timer starts counting at the time when the engine 1 is stopped last time.

Subsequently, the ECU 50 determines whether vapors have been produced in the fuel supply device 44 (step S12). Specifically, the ECU 50 determines whether vapors have been produced in the fuel supply device 44 on the basis of the information acquired in step S11 and the vapor production prediction map shown in FIG. 4.

When the ECU 50 determines that vapors have been produced in the fuel supply device 44 (YES in step S12), the process proceeds to step S13. On the other hand, when it is determined that vapors have not been produced in the fuel supply device 44 (NO in step S12), the process proceeds to step S16, and normal feedback control is executed. Here, the normal feedback control means air-fuel ratio feedback control that uses a pre-changed feedback gain.

When the process proceeds to step S13, the ECU 50 changes the feedback gain. The changed feedback gain is obtained through empirical measurement in advance, and is stored in the ROM. As described above, a change of the feedback gain may be executed in at least one of main feedback control and sub-feedback control. Thus, when the ECU 50 refers to a value that indicates the changed feedback gain by consulting the ROM, the ECU 50 executes air-fuel ratio feedback control using the value.

Subsequently, the ECU 50 predicts a vapor production time (step S14). As described above, the ECU 50 predicts a vapor production time that indicates a period of time during which vapors may be contained in fuel that is supplied into the combustion chambers 14 on the basis of the engine rotation speed and the engine load.

Subsequently, the ECU 50 determines whether vapor production end time has been reached (step S15). The vapor production end time is the time that indicates a lapse of the vapor production time predicted in step S14 from a start of the engine 1. The ECU 50 starts counting with the use of the timer at the beginning of a start of the engine 1, and determines whether the count of the timer has reached the vapor production end time.

When the ECU 50 determines that the vapor production end time has not been reached (NO in step S15), this step is repeated. On the other hand, when it is determined that the vapor production end time has been reached (YES in step S15), the process proceeds to step S16, and normal feedback control is executed.

As described above, when vapors have been produced in the fuel supply device 44, the ECU 50 according to the present embodiment is able to decrease the feedback gain in air-fuel ratio feedback control. By so doing, even when the fuel injection amount is increased in order to promptly remove vapors from the fuel supply device 44, it is possible to suppress occurrence of engine stalling due to a decrease in the fuel injection amount such that the air-fuel ratio is corrected toward a lean side through air-fuel ratio feedback control. It is possible to execute air-fuel ratio feedback control from a start of the engine 1, so it is possible to suppress an excessive increase in the fuel injection amount when vapors in the fuel supply device 44 are removed in the case where air-fuel ratio feedback control is not executed at the time of a start of the engine. Thus, it is possible to suppress deterioration of exhaust gas characteristic and occurrence of engine stalling by optimizing air-fuel ratio feedback control at the time of a start of the engine 1.

The ECU 50 is able to predict whether vapors have been produced in the fuel supply device 44 on the basis of the lubricant temperature and coolant temperature of the engine 1 and a stop time of the engine 1, so it is possible to accurately predict whether vapors have been produced and to execute air-fuel ratio feedback control in response to a situation of production of vapors.

The ECU 50 ends a decrease in the feedback gain after, a lapse of the predetermined period of time from the start of the engine 1, so, when vapors contained in fuel in the fuel supply device 44 have been removed, it is possible to further promptly bring an actual air-fuel ratio into coincidence with a target air-fuel ratio by returning the feedback gain to a normal value.

The ECU 50 sets the predetermined period of time on the basis of the amount of air detected by the air flow meter 26, so it is possible to accurately estimate a period of time during which vapors contained in fuel in the fuel supply device 44 are removed, and, when vapors have been removed, it is possible to promptly return the feedback gain to a normal value.

The above description is made on the example in which the internal combustion engine according to the invention is formed of a gasoline engine; however, the internal combustion engine is not limited to this configuration. The internal combustion engine may be formed of an internal combustion engine that uses light oil or alcohol as fuel.

The above description is made on the case where the internal combustion engine according to the invention is applied to a port-injection-type engine; however, the internal combustion engine is not limited to this configuration. The internal combustion engine may be applied to a direct-injection-type engine that directly supplies fuel into each combustion chamber 14 or a dual-type engine that carries out both port injection and direct injection.

As described above, the control device according to the invention is advantageously able to suppress deterioration of exhaust gas characteristic and occurrence of engine stalling by optimizing air-fuel ratio control at the time of a start of the internal combustion engine, and is useful in the control device for an internal combustion engine.

The invention claimed is:

1. A control device for an internal combustion engine, the control device comprising:

an air-fuel ratio detector provided in an exhaust passage of the internal combustion engine and configured to detect an air-fuel ratio of exhaust gas of the internal combustion engine; and an electronic control unit programmed to (a) predict whether vapors have been produced in fuel in a fuel supply device at the time of a start of the internal combustion engine on the basis of a lubricant temperature and coolant temperature of the internal combustion engine and a stop time of the internal combustion engine, (b) execute air-fuel ratio feedback control for bringing the air-fuel ratio in the internal combustion engine close to a target air-fuel ratio by controlling a fuel injection amount of the fuel supply device, the fuel supply device injecting fuel into a combustion chamber of the internal combustion engine, on the basis of the air-fuel ratio detected by the air-fuel ratio detector, and (c) increase the fuel injection amount and decrease a feedback gain in the air-fuel ratio feedback control when the electronic control unit predicts that vapors have been produced as compared with when the electronic control unit predicts that vapors have not been produced.

2. The control device according to claim 1, wherein the electronic control unit ends a decrease in the feedback gain after a lapse of a predetermined period of time from the start of the internal combustion engine.

3. The control device according to claim 2, further comprising:

at least one sensor in communication with the electronic control unit and configured to detect an amount of air, the amount of air being taken into the internal combustion engine, wherein the electronic control unit sets the predetermined period of time on the basis of the amount of air detected by the at least one sensor.

4. A control method for an internal combustion engine, using an air-fuel ratio detector and an electronic control unit, the control method comprising:

detecting, by the air-fuel ratio detector, an air-fuel ratio of exhaust gas in an exhaust passage of the internal combustion engine;

predicting, by the electronic control unit, whether vapors have been produced in fuel in a fuel supply device at the time of a start of the internal combustion engine on the basis of a lubricant temperature and coolant temperature of the internal combustion engine and a stop time of the internal combustion engine;

executing, by the electronic control unit, air-fuel ratio feedback control for bringing the air-fuel ratio in the internal combustion engine close to a target air-fuel ratio by controlling a fuel injection amount of the fuel supply device, the fuel supply device injecting fuel into a combustion chamber of the internal combustion engine, on the basis of the detected air-fuel ratio; and increasing, by the electronic control unit, the fuel injection amount and decreasing, by the electronic control unit, a feedback gain in the air-fuel ratio feedback control when the electronic control unit predicts that vapors have been produced as compared with when the electronic control unit predicts that vapors have not been produced.

* * * * *